United States Patent [19]

Martin, Sr.

[11] Patent Number: 4,505,482

[45] Date of Patent: Mar. 19, 1985

[54] ARCHERY BROADHEAD

[76] Inventor: Ricky T. Martin, Sr., 6065 Hathaway Rd., Lebanon, Ohio 45036

[21] Appl. No.: 549,042

[22] Filed: Nov. 7, 1983

[51] Int. Cl.[3] ..... F41B 5/02

[52] U.S. Cl. ..... 273/421; D22/12

[58] Field of Search ..... 273/419–422; D22/12

[56] References Cited

U.S. PATENT DOCUMENTS

| | | | |
|---|---|---|---|
| D. 209,283 | 11/1967 | Smith | D22/12 |
| 2,212,345 | 8/1940 | Krieger | 273/421 X |
| 2,880,000 | 3/1959 | Unger | 273/422 |
| 3,910,579 | 10/1975 | Sprandel | 273/422 |
| 4,381,866 | 5/1983 | Simo | 273/422 |

OTHER PUBLICATIONS

Archery, 1,2 or 3/1967, The 003.
Archery, 1–1967, Eagle Broadhead.
Archery, 9–1967, Hughes–Smith Co. Inc. Ad.
Archer's Bible 1966–1967, 3/1967, pp. 75 & 76.

*Primary Examiner*—Paul E. Shapiro
*Attorney, Agent, or Firm*—Biebel, French & Nauman

[57] ABSTRACT

An archery broadhead includes a centrally located ferrule around which are symmetrically mounted a plurality of blades, ideally three or more in number. Each of the blades has an outer edge which slopes rearwardly at a first, shallow angle from a needle-like point for maximum initial penetration, and then extends outwardly at a much steeper angle to cause maximum damage as the steeper angled portion follows the shallower angled portion into the opening which it has created.

20 Claims, 6 Drawing Figures

ARCHERY BROADHEAD

BACKGROUND OF THE INVENTION

1. Field of the Invention

The present invention is directed to broadheads of the type used in game hunting.

2. Prior Art

Conventionally, game broadheads consist of a central ferrule around which are mounted two or more blades, with three to four blades being most common.

In all of the broadheads of which applicant is aware, the outer, cutting edges of the blades fall into one of four different categories. These are: (1) a straight outer edge extending at a constant angle to the longitudinal axis of the broadhead; (2) a concave outer edge; (3) a convex outer edge; and (4) a sawtooth edge.

Additionally, in some broadheads the tips of the blades meet at a point, while in others the tips of the blades are set back from a pointed centerpiece, which may be of an approximately bullet-shaped configuration.

It is generally recognized that the optimum qualities desired in a broadhead are accuracy and silence in flight, high penetrating ability, and maximum damage upon impact to cause a large wound which will both bring down the game struck in the shortest period of time and provide an open, profusely bleeding wound to facilitate tracking. All of the broadheads described above are designed with one or more of these considerations in mind, but each, it is believed, requires a tradeoff of one characteristic in favor of another.

SUMMARY OF THE INVENTION

The broadhead of the present invention provides exceedingly accurate and silent flight, with optimum initial game penetration followed by massive damage, resulting in profuse external bleeding and quick kills.

In accordance with the present invention, the broadhead consists of a plurality of blades mounted about a central, conical ferrule, with each of the blades having an initial portion of substantial length but tapered rearwardly at a relatively shallow angle and a second portion of substantially shorter length, but extending outwardly at an angle that is relatively steep with respect to the angle of the first portion of the blade. While the elongated section of the broadhead formed by the first, elongated portions of the blades is imperforate, the trailing section of the broadhead formed by the second, more steeply angled portions of the blades is vented.

These features of the broadhead provide the desired characteristics described above. Thus, by venting only the rear section of the broadhead, the flight of the arrow is relatively silent. However, the vents in the wider rear section of the broadhead permit air to flow through them as the boradhead spins in flight. This in turn provides a straighter, true trajectory. The necessity of venting the forward section of the broadhead is obviated by virtue of its relatively narrow, low clean profile.

With respect to the forward section of the broadhead, the relatively narrow portions of the blades will drill a starter opening in the game upon impact of the spinning arrow. This provides high initial penetration.

As the much wider rear section of the broadhead follows, it enters into the precut area more freely and with commensurately reduced drag on the broadhead.

The result is that the broadhead can penetrate much more completely while at the same time opening a relatively wide area wound which has the effect of decreasing kill time and causing profuse external bleeding to facilitate tracking.

BRIEF DESCRIPTION OF THE DRAWINGS

The above features and advantages of the present invention will be more fully and clearly understood from the following detailed description of the invention in which.

Figure 1:
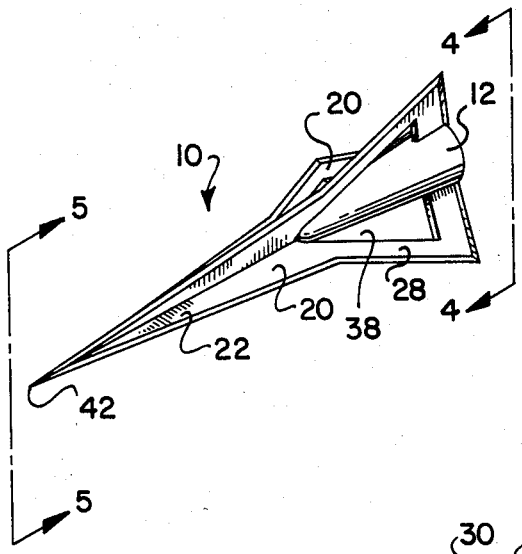
FIG. 1 is a perspective view of one embodiment of broadhead in accordance with the present invention.

Other objects and advantages of the invention will be apparent from the following description, the accompanying drawings and the appended claims.

DESCRIPTION OF THE INVENTION

In accordance with a preferred embodiment of the invention, the broadhead 10 may include a tapered ferrule 12 having a closed, conical forward end 14, and an open rearward end 16.

Mounted symmetrically about and projecting radially outwardly of the ferrule 12 are a plurality of blades 20. Each blade 20 has a first, leading portion 22 having a substantially straight outer edge 24 defining with a longitudinal axis 26 a first acute angle $\alpha$. Each blade 20 also includes a second, trailing blade portion 28, which also has a substantially straight outer edge 30 terminating as an apex 31 and defining with the longitudinal axis 26 a second acute include angle $\beta$.

The trailing blade portion 28 also has a trailing edge 32 which defines with the longitudinal axis 26 an obtuse exterior angle $\gamma$.

Figure 2:
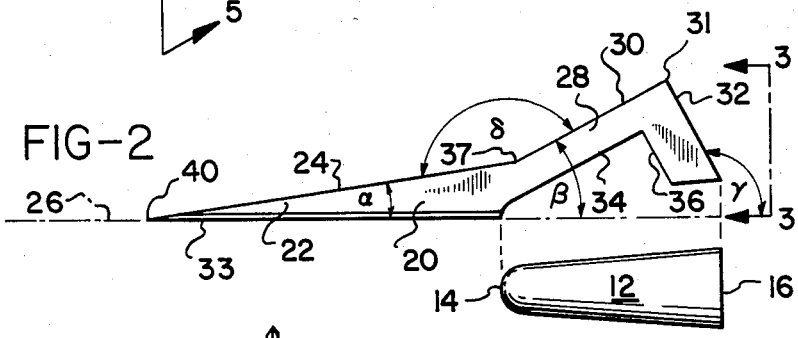
FIG. 2 is a side elevational view of a blade and ferrule in accordance with the present invention with the two separated for purposes of clarity.

It will be noted from FIG. 2 of the drawings that $\beta$ is approximately three times $\alpha$ and that the edges 24 and 30 define an obtuse included angle $\delta$.

Figure 3:
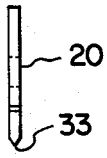
FIG. 3 is an end view of a blade taken substantially along line 3—3 of FIG. 2.

In a preferred embodiment of the invention, portions 22 of the blade have inner edges 33, which are beveled as seen in FIGS. 2 and 3, to permit the blades to mate with each other so that they can be secured in any convenient fashion, such as by welding or adhesives.

The rear portions 28 have inner edges 34 and 36 which define with an outer surface of the ferrule 12 substantially triangularly shaped vent openings 38.

It will also be noted that each of the leading blade portions 26 terminates at its forward end in an acutely angled point 40 which merges with the corresponding points of other blades to form an integral, acutely angled, needle-like penetrating point 42.

While each of the blades is described as having leading and trailing portions having outer edges 24 and 30, respectively, it will be seen that the rearwardmost point on edge 24 and the forwardmost point on edge 30 coincide at point 37, so that a continuous, uninterrupted blade outer edge is presented as opposed to, for example, a sawtooth type outer edge.

While the broadhead shown in FIGS. 1–5 consists of three blades, it will be apparent that the number of blades may be varied. In this regard, it will be noted in FIG. 6 of the drawings that a broadhead 50 may be constructed in accordance with the present invention which includes a ferrule 52 and blades 54. Blades 54 correspond to the blades 20 except that the inner edges of the blades 54 corresponding to the edges 33 of the blades 20 will be beveled at a different angle. In all other respects, the blades 20 and 54 may be the same.

In a preferred embodiment of the invention, the angle $\alpha$ is approximately 9°, while the angle $\beta$ is approximately 28°. The angle $\gamma$ is approximately 119°, and the angle $\delta$ 160°.

Preferably, portion 22 is at least 1½ times as long as portion 28 measured along the longitudinal axis 26. However, the maximum width of portion 22 measured from the longitudinal axis 26 to point 37 is less than half the maximum width of portion 28 measured from the longitudinal axis 26 to the apex of portion 28. For example, with a maximum width of 0.25 inches for portion 22, portion 28 will have a maximum width of 0.625 inches, providing an overall broadhead diameter of 1¼ inches, while the overall weight of the broadhead is approximately 100 grains.

With regard to the latter, while it is desirable to reduce the weight of a broadhead, in practice it will be found that in order to attain a desired diameter, most broadheads weigh substantially in excess of 100 grains. However, by proportioning the broadhead of the present invention with a relatively long, narrow leading portion and a wide, vented rear portion, a broadhead of desired maximum diameter yet low weight is obtained, permitting the broadhead of the present invention to weigh in at an unusually light weight of approximately 100 grains while providing an effective outer diameter of 1¼ inches.

Figure 4:
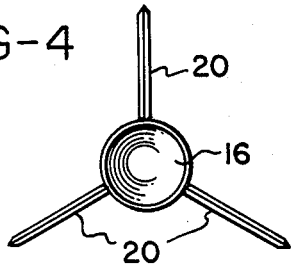
FIG. 4 is a rear view taken substantially along line 4—4 of FIG. 1.
Figure 5:
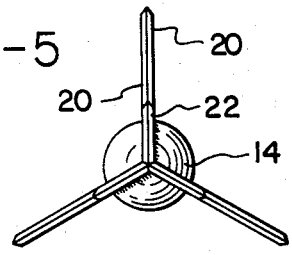
FIG. 5 is a front view taken substantially along line 5—5 of FIG. 1.
Figure 6:
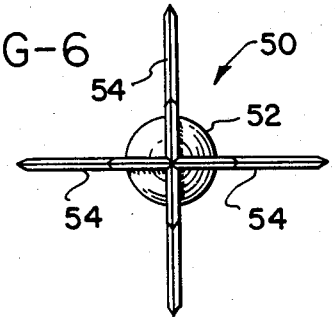
FIG. 6 is a view similar to FIG. 5, but showing a second embodiment of the invention.

The outer edges 24 and 30 of the blades 20 are sharpened as shown in FIG. 1. An additional advantage of the particular configuration of the blades 20 is that the outer edges can be easily sharpened using a flat sharpening stone or the like. With each of the edges 24 and 30 being substantially straight, the edges 24 of an adjacent pair of blades can be sharpened simultaneously by orienting the broadhead as shown in FIGS. 4 and 5 with respect to the horizontal surface of the sharpening stone and with points 37 on the blades aligned with the edge of the stone. After all edges 24 have been sharpened in this manner, edges 30 are sharpened in the same way.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In an improved broadhead comprising a ferrule for mounting said broadhead on a shaft and a plurality of blades mounted on said ferrule and projecting outwardly therefrom in planes substantially coincident with a longitudinal axis of said ferrule, the improvement comprising:

each of said blades including a first, leading portion and a second, trailing portion;

said first, leading blade portion having a straight outer edge extending rearwardly from an acutely angled point thereof and defining with said longitudinal axis of said ferrule a first, acute included angle;

said second, trailing blade portion having a straight outer edge defining with said longitudinal axis of said ferrule a second acute, included angle;

said second acute, included angle being substantially greater than said first acute, included angle; and a forwardmost point on said outer edge of said second trailing blade portion coinciding with a rearwardmost point on said outer edge of said first leading blade portion.

2. The broadhead of claim 1 wherein:

said acutely angled points of said leading blade portions merge to form an integral, acutely angled, needle-like penetrating point.

3. The broadhead of claim 1 wherein:

each of said trailing blade portions has a trailing edge defining with said longitudinal axis of said ferrule an obtuse exterior angle.

4. The broadhead of claim 1 wherein:

said trailing blade portions each have a substantially straight inner edge portion defining with an outer surface of said ferrule substantially triangularly shaped openings.

5. The broadhead of claim 1 wherein:

said second acute, included angle is at least twice as great as said first acute included angle.

6. The broadhead of claim 1 wherein:

said second acute, included angle is approximately three times as great as said first acute included angle.

7. The broadhead of claim 1 wherein:

the total weight thereof is approximately 100 grains.

8. The broadhead of claim 1 wherein:

the maximum diameter thereof normal to said ferrule longitudinal axis is approximately 1¼ inches.

9. The broadhead of claim 1 wherein:

said leading blade portions each have a substantially straight inner edge; and said leading blade portions inner edges are beveled to mate with each other.

10. The broadhead of claim 1 wherein:

said plurality of blades comprises three.

11. The broadhead of claim 1 wherein:

said plurality of blades comprises four.

12. The broadhead of claim 1 wherein:

triangularly shaped vent openings are provided only at said trailing blade portions.

13. The broadhead of claim 1 wherein:

said leading blade portion is substantially longer than said trailing blade portion.

14. The broadhead of claim 1 wherein:

the distance from said ferrule longitudinal axis to the outermost point on said trailing blade portion is substantially greater than the distance from said ferrule longitudinal axis to the outermost point on said leading blade portion.

15. An improved broadhead comprising:

a tapered ferrule adapted to mount said broadhead on a shaft;

a plurality of substantially identical, thin flat blades mounted around and projecting radially outwardly of said ferrule;

each of said blades consisting of a leading portion and a trailing portion;

each of said leading portions consisting of inner edges merging with each other and extending coincident with a longitudinal axis of said ferrule and a straight outer edge extending rearwardly from an acutely angled point thereof at a first acute angle to said longitudinal axis to a rearwardmost point;

each of said trailing portions consisting of an inner edge spaced from and defining with an outer surface of said ferrule a substantially triangular space, a straight outer edge extending at a second acute angle to said longitudinal axis substantially greater than said first acute angle from a forwardmost point on said trailing portion edge to an outer apex thereof, and a trailing edge defining with said longitudinal axis an obtuse exterior angle; and said leading portions being substantially longer and narrower than said trailing portions and said rearwardmost point on said leading portion and said forwardmost point on said trailing portion being coincident to define a continuous, uninterrupted blade outer edge.

16. The broadhead of claim 15 wherein:

said trailing portion is at least twice as wide at its apex as said leading portion is at its rearwardmost point.

17. The broadhead of claim 15 wherein:

said leading portion is at least 1½ times as long as said trailing portion.

18. The broadhead of claim 15 wherein:

said second acute included angle is at least twice as great as said first acute included angle.

19. The broadhead of claim 15 wherein:

said forward ends of said leading portions merge to form a needle-like penetrating point.

20. In an improved broadhead comprising a ferrule for mounting said broadhead on a shaft and a plurality of blades mounted on said ferrule and projecting outwardly therefrom in plane substantially coincident with a longitudinal axis of said ferrule, the improvement comprising:

each of said blades including a first leading portion and a second, trailing portion;

said first, leading blade portion having a straight outer edge extending rearwardly from an acutely angled point thereof and defining with said longitudinal axis of said ferrule a first, acute included angle;

said second, trailing blade portion having a straight outer edge defining with said longitudinal axis of said ferrule a second acute, included angle;

said second acute, included angle being at least twice as great as said first acute, included angle;

said acutely angled points of said leading blade portions merging to form an integral, acutely angled, needle-like penetrating point;

a forwardmost point on said outer edge of said second trailing blade portion coinciding with a rearwardmost point on said outer edge of said first leading blade portion;

said trailing blade portions each having a substantially straight inner edge portion defining with an outer surface of said ferrule substantially triangularly-shaped openings;

said leading blade portion being substantially londer than said trailing blade portion;

the distance from said ferrule longitudinal axis to the outermost point on said trailing blade portion being substantially greater than the distance from said ferrule longitudinal axis to the outermost point on said leading blade portion; and vent openings are provided only at said trailing blade portions.

* * * * *